US006883979B2

(12) United States Patent
Ueda et al.

(10) Patent No.: US 6,883,979 B2
(45) Date of Patent: Apr. 26, 2005

(54) SERIAL PRINTER DETECTING SET CONDITION FOR IMAGE FORMATION AND METHOD OF CONTROLLING THE SAME

(75) Inventors: Atsushi Ueda, Nara (JP); Hirotoshi Iemura, Nara (JP); Hajime Horinaka, Kashiba (JP); Masaharu Kimura, Daito (JP); Norihiro Ochi, Sakurai (JP); Shunichi Hayashiyama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/147,968

(22) Filed: May 20, 2002

(65) Prior Publication Data

US 2002/0136583 A1 Sep. 26, 2002

Related U.S. Application Data

(63) Continuation of application No. 09/480,649, filed on Jan. 11, 2000, now Pat. No. 6,419,409.

(30) Foreign Application Priority Data

Jan. 14, 1999 (JP) ..... 11-008067

(51) Int. Cl.[7] ..... B41J 23/00

(52) U.S. Cl. ..... 400/59; 400/55; 400/56; 400/283; 347/8; 347/37

(58) Field of Search ..... 400/55, 56, 59, 400/323, 319, 322, 709, 284, 283, 294, 291, 705, 705.3, 34, 323.1; 347/37, 39, 8

(56) References Cited

U.S. PATENT DOCUMENTS

| | | | | |
|---|---|---|---|---|
| 4,647,233 A | | 3/1987 | Noda et al. | |
| 5,193,918 A | | 3/1993 | Lohrmann et al. | |
| 5,476,328 A | | 12/1995 | Hori | |
| 5,570,959 A | | 11/1996 | Moriwaki et al. | |
| 5,610,636 A | | 3/1997 | Hanabusa et al. | |
| 5,704,721 A | | 1/1998 | Ikehata et al. | |
| 5,887,987 A | | 3/1999 | Sawano | |
| 6,004,050 A | | 12/1999 | Rehman et al. | |
| 6,102,519 A | | 8/2000 | Yasui et al. | |
| 6,419,409 B1 | * | 7/2002 | Ueda et al. | 400/56 |

FOREIGN PATENT DOCUMENTS

| | | |
|---|---|---|
| EP | 0364262 | 4/1990 |
| EP | 0400608 | 12/1990 |
| JP | A5-318830 | 12/1993 |
| JP | 7-276736 A | 10/1995 |
| JP | 10287010 | 10/1998 |
| JP | 10316248 | 12/1998 |

* cited by examiner

*Primary Examiner*—Ren Yan
*Assistant Examiner*—Kevin D. Williams
(74) *Attorney, Agent, or Firm*—Birch, Stewart, Kolasch & Birch, LLP

(57) ABSTRACT

The serial printer includes a carriage reciprocating in a main scanning direction, a reading sensor mounted in carriage, a timing fence arranged in the main scanning direction, a mechanism preventing movement of carriage in the main scanning direction, and a controlling portion detecting a set condition for image formation in accordance with read data of timing fence from reading sensor for controlling image formation. The controlling portion detects the set condition for image formation in accordance with the read data obtained from the timing fence, so that detection of the set condition for image formation is enabled without increasing the size of an apparatus and cost, or without decreasing a processing efficiency in image formation.

25 Claims, 13 Drawing Sheets

SERIAL PRINTER DETECTING SET CONDITION FOR IMAGE FORMATION AND METHOD OF CONTROLLING THE SAME

This application is a continuation of application Ser. No. 09/480,649, filed on Jan. 11, 2000, now U.S. Pat. No. 6,419,409 the entire contents of which are hereby incorporated by reference and for which priority is claimed under 35 U.S.C. § 120; and this application claims priority of Application No. 11-008067 filed in Japan on Jan. 14, 1999 under 35 U.S.C. § 119.

BACKGROUND OF THE INVENTION

1. Field of the Invention

The present invention relates to a serial printer such as an ink-jet printer by moving a head forward and backward in main scanning directions with respect to a sheet of paper transported in a sub scanning direction for forming an image on the sheet of paper.

2. Description of the Background Art

Serial printers including an ink-jet printers move a head forward and backward in main scanning directions with respect to a sheet of paper transported in a sub scanning direction for forming an image on the sheet of paper. In an ink-jet printer, for example, ink is emitted from a plurality of nozzles arranged at a head against a sheet of paper. A predetermined space is ensured between a leading edge of the nozzle and the sheet of paper so that an image is properly formed on the sheet of paper by the emitted ink.

In other words, if the head is too close to the sheet of paper, the sheet of paper may be brought into contact with the head, thereby causing head wearing or damage. On the other hand, if there is too much space between the head and the sheet of paper, an image may be marred by a so-called satellite phenomenon. The satellite phenomenon is caused when fine ink droplets emitted from the nozzles of the head following main droplets of the ink improperly adhere to the sheet of paper, at locations apart from the main droplets. More specifically, as shown in FIG. 1A, if the distance between head 101 and sheet of paper 102 is appropriate, fine ink droplets 111 to 113 are emitted against the location where main droplet 110 adheres. In this case, the image on the sheet of paper 102 is not marred. On the other hand, as shown in FIG. 1B, if the distance between head 101 and paper 102 is too long, fine ink droplets 111 to 113 are emitted against the portion other than where the ink main droplets 110 adhere, thereby marring the image on the sheet of paper 102.

Then, in the conventional serial printer, a position of the head has been made adjustable in a direction vertical to the sheet of paper (in a direction of height), so that the position of the head can be adjusted in the height direction in accordance with a thickness of the sheet of paper on which the image is to be formed. Thus, a distance between the sheet of paper and the head is maintained at a constant value regardless of a thickness of the sheet of paper. Normally, such adjustment of the head is performed by an operating member such as a height adjustment lever, which is arranged for example at the side of the apparatus.

In addition, in the serial printer, an image formation scope in the main scanning direction in which the head is to be moved changes with the size of paper on which the image is to be formed. Therefore, to increase the operating efficiency of the printer by reducing the time required for image formation, the head must be moved forward and backward only over the scope in the main scanning direction of the sheet of paper on which the image is to be formed. To this end, a means for detecting a length of the set sheet of paper in the main scanning direction should be provided.

However, provision of a structure which is only used for detecting the length of the sheet of paper in the main scanning direction results in increase in size of the apparatus and cost. Thus, a relatively low-priced small serial printer is not provided with a structure for detecting the length of the sheet of paper in the main scanning direction and, the head is moved forward and backward in the main scanning directions over the entire scope corresponding to a maximum sized sheet of paper on which an image is to be formed.

However, the conventional serial printer is not provided with a simple structure for detecting a set condition for image formation such as a position of the head in the height direction or a paper size. Thus, determination cannot be made as to whether the image forming conditions are properly set. As a result, degradation of the image quality as well as wearing and damage of the apparatus are caused.

For example, an image formation process is performed even when the position of the head adjusted by a user does not correspond to a thickness of the printing sheet of paper, thereby resulting in head wearing or damage as well as degradation of the image quality. Further, if the head is to be moved forward and backward in the main scanning directions over the entire scope of the maximum sized paper during image formation regardless of a width of the sheet of paper on which the image is to be formed, the head is even moved over the scope with no sheet of paper. This disadvantageously increases image production time and decreases operating efficiency. In addition, the apparatus may be subjected to taint damage caused by insertion of a sheet of paper not corresponding to the image data size.

SUMMARY OF THE INVENTION

An object of the present invention is to provide a serial printer capable of detecting a set condition for image formation such as a position of a head or a size of a sheet of paper without increasing size of an apparatus and cost.

An another object of the present invention is to provide a serial printer capable of detecting a set condition for image formation such as a position of a head or a size of a sheet of paper without decreasing a processing efficiency in image formation.

Another object of the present invention is to provide a method of controlling a serial printer capable of detecting a set condition for image formation such as a position of a head or a size of a sheet of paper without increasing a size of an apparatus and cost.

Another object of the present invention is to provide a method of controlling a serial printer capable of detecting a set condition for image formation such as a position of a head or a size of a sheet of paper without decreasing a processing efficiency in image formation.

According to one aspect of the present invention, a serial printer includes a carriage moving forward and backward in main scanning directions, a reading sensor mounted on the carriage, a timing fence arranged in the main scanning direction, a mechanism preventing movement of the carriage in the main scanning directions in accordance with a set condition for image formation, and a controlling portion detecting the set condition for image formation in accordance with read data of the timing fence from the reading sensor for controlling image formation.

Since the set condition for image formation is detected in accordance with the read data of the timing fence from the reading sensor, the problem associated with the increase in size of the apparatus and cost is alleviated and the processing efficiency in image formation is not decreased.

According to another aspect of the present invention, a method of controlling a serial printer is provided. The serial printer includes a carriage moving forward and backward in main scanning directions, a reading sensor mounted on the carriage, a timing fence arranged in the main scanning direction and a mechanism preventing movement of the carriage in the main scanning direction in accordance with a set condition for image formation. The method includes a step of detecting the set condition for image formation in accordance with read data of the timing fence from the reading sensor, and a step of controlling image formation in accordance with the detection result.

Since the set condition for image formation is detected in accordance with the read data of the timing fence from the reading sensor, the problem associated with the increase in size of the apparatus and cost is alleviated and the decrease in the processing efficiency in image formation is prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1B:
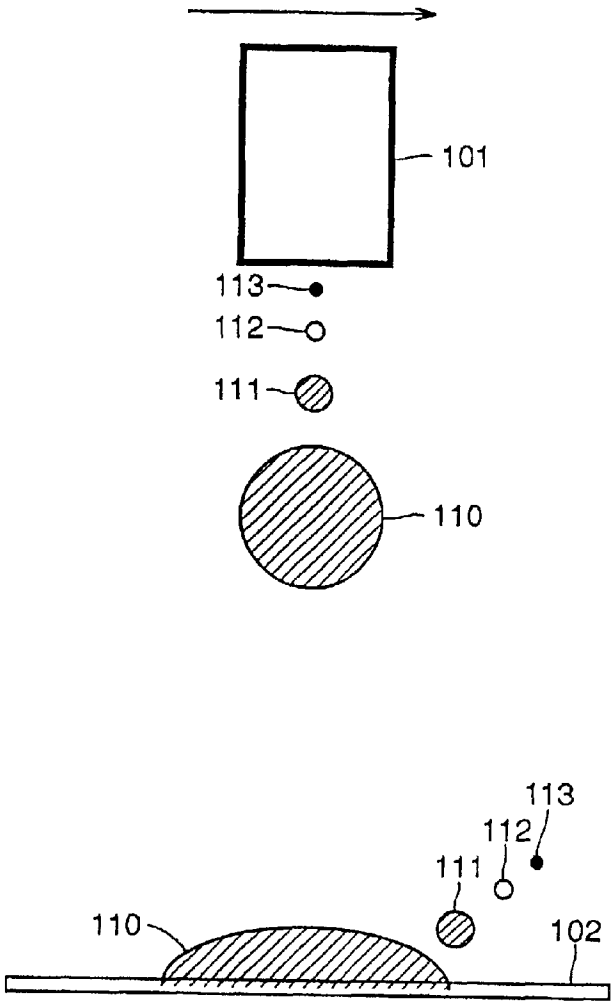
FIG. 1B PRIOR ART
FIGS. 1A and 1B are diagrams shown in conjunction with a satellite phenomenon caused by improper setting of a distance between a head of an ink cartridge and a sheet of recording paper in a conventional ink-jet printer.
Figure 1A:
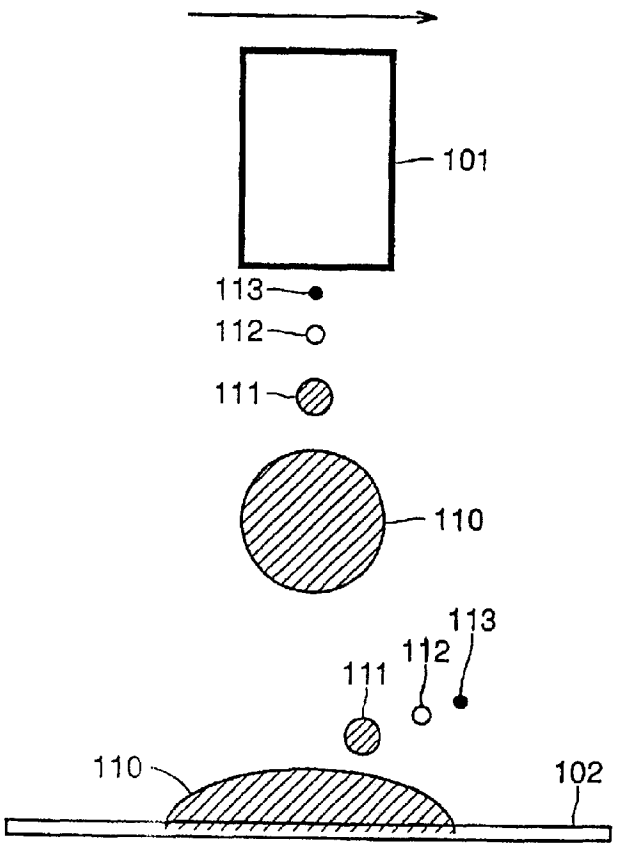
FIG. 1A PRIOR ART
Figure 2:
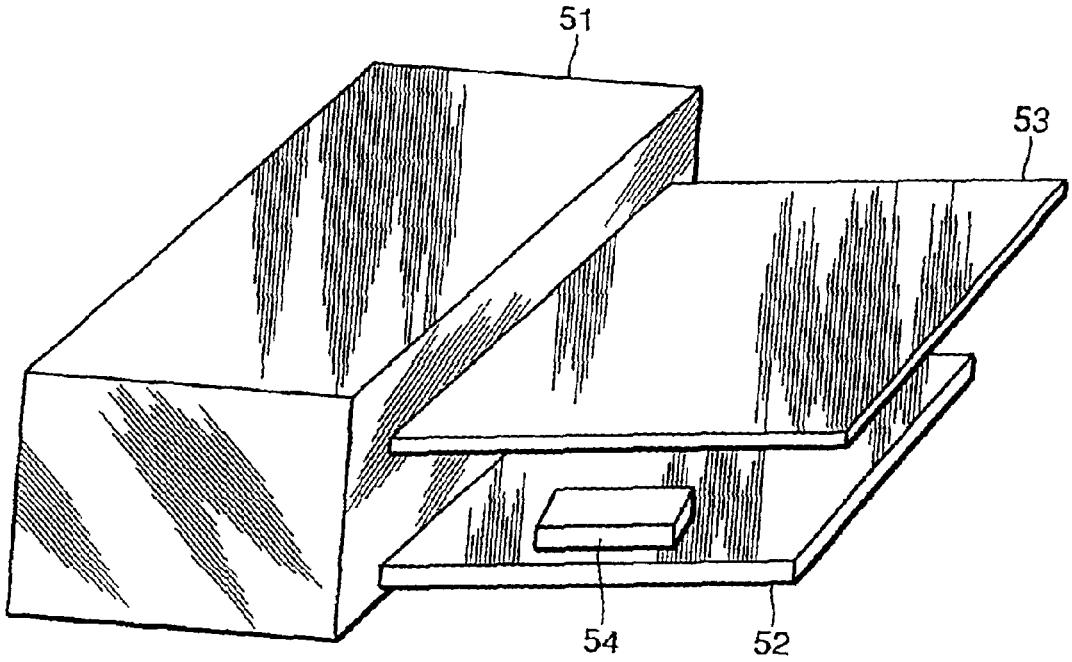
FIG. 2 is a view showing a serial printer according to an embodiment of the present invention.

Referring to FIG. 2, a serial printer body 51 is provided on its front side a discharging tray 53 and a feeding tray 52 therebelow. A guide plate 54 is provided on an upper surface of feeding tray 52, which is movable over a prescribed range in a direction perpendicular to the feeding direction of paper. Guide plate 54 would be contact with a side surface of a plurality of sheets of paper placed on the upper surface of feeding tray 52 for aligning them.

Figure 3:
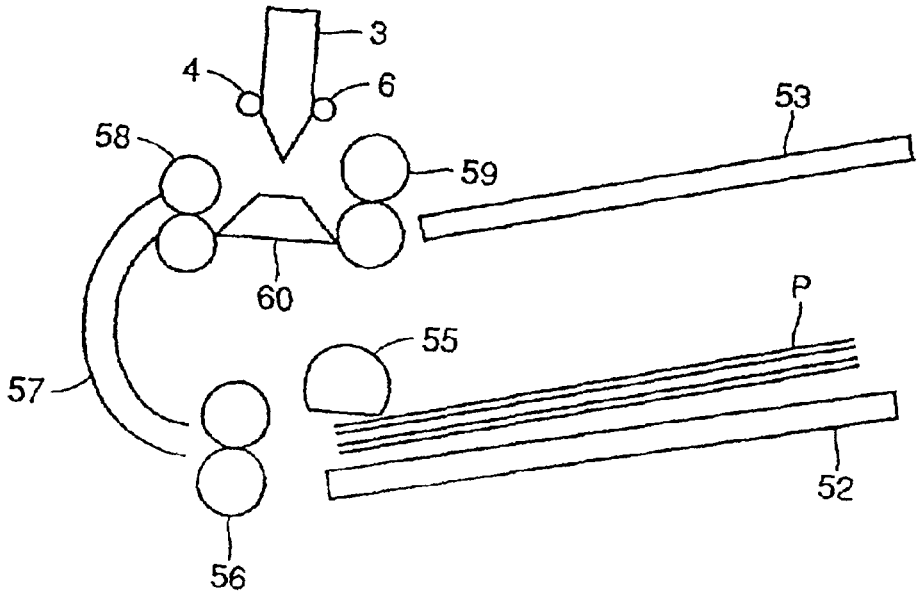
FIG. 3 is a schematic diagram showing the serial printer according to the embodiment of the present invention.

Referring to FIG. 3, provided inside serial printer body 51 are a feeding roller 55, transport roller 56, transport guide 57, resist roller 58, discharging roller 59, platen 60, ink cartridge 3, slide shaft 4 and holding shaft 6. Feeding roller 55 feeds sheets of paper P placed on feeding tray 52 by rotation, one sheet at a time, toward transport roller 56. Transport roller 56 guides the brought sheet of paper P on a transport path 57. Resist roller 58 guides sheet of paper P between platen 60 and ink cartridge 3 in synchronization with the movement of ink cartridge 3 in the main scanning direction. Discharging roller 59 discharges printed sheet of paper P onto discharging tray 53.

Slide shaft 4 and holding shaft 6 guide ink cartridge 3 in the main scanning direction. Ink cartridge 3 emits ink against sheet of paper P from the head at a low end in accordance with image data during one forward movement in the main scanning directions. During that time, transportation of the sheet of paper in the sub scanning direction by resist roller 58 is suspended. Resist roller 58 transports sheet of paper P in the sub scanning direction by a distance corresponding to a number of nozzles provided in the sub scanning direction at the head during a backward movement of ink cartridge 3. Thus, sheet of paper P is repeatedly transported by a prescribed distance in the sub scanning direction by resist roller 58 during reciprocating movements of ink cartridge 3 in the main scanning directions, so that an image is formed over the entire sheet of paper P.

Figure 4:
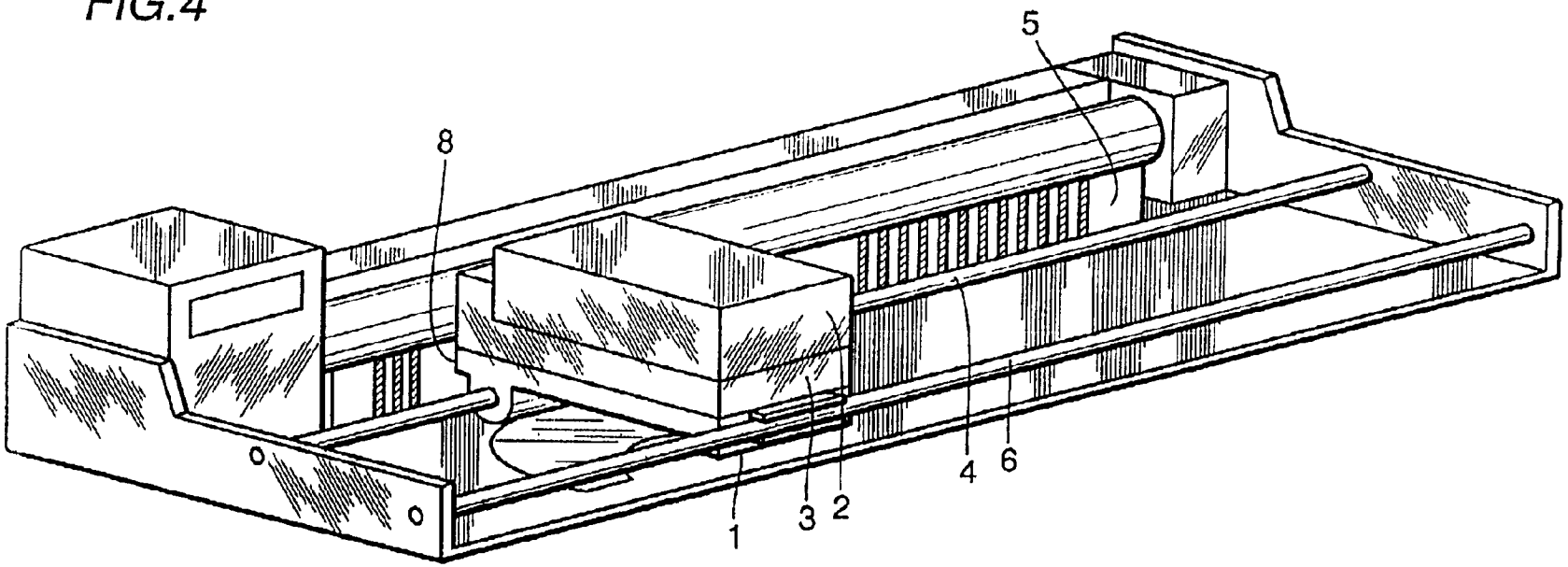
FIG. 4 is a view showing a peripheral structure of an ink cartridge 3 of the serial printer according to the embodiment of the present invention.

FIG. 4 is a perspective view showing a peripheral structure of ink cartridge 3 in the above described serial printer. In serial printer body 51, ink cartridge 3 is mounted on carriage 1 together with an ink tank 2. Carriage 1 is guided by slide shaft 4 and holding shaft 6 that are arranged in parallel in the main scanning direction, and reciprocates in the main scanning directions. Timing fence 5 faces reading sensor 8 provided on the back of carriage 1.

Figure 5:
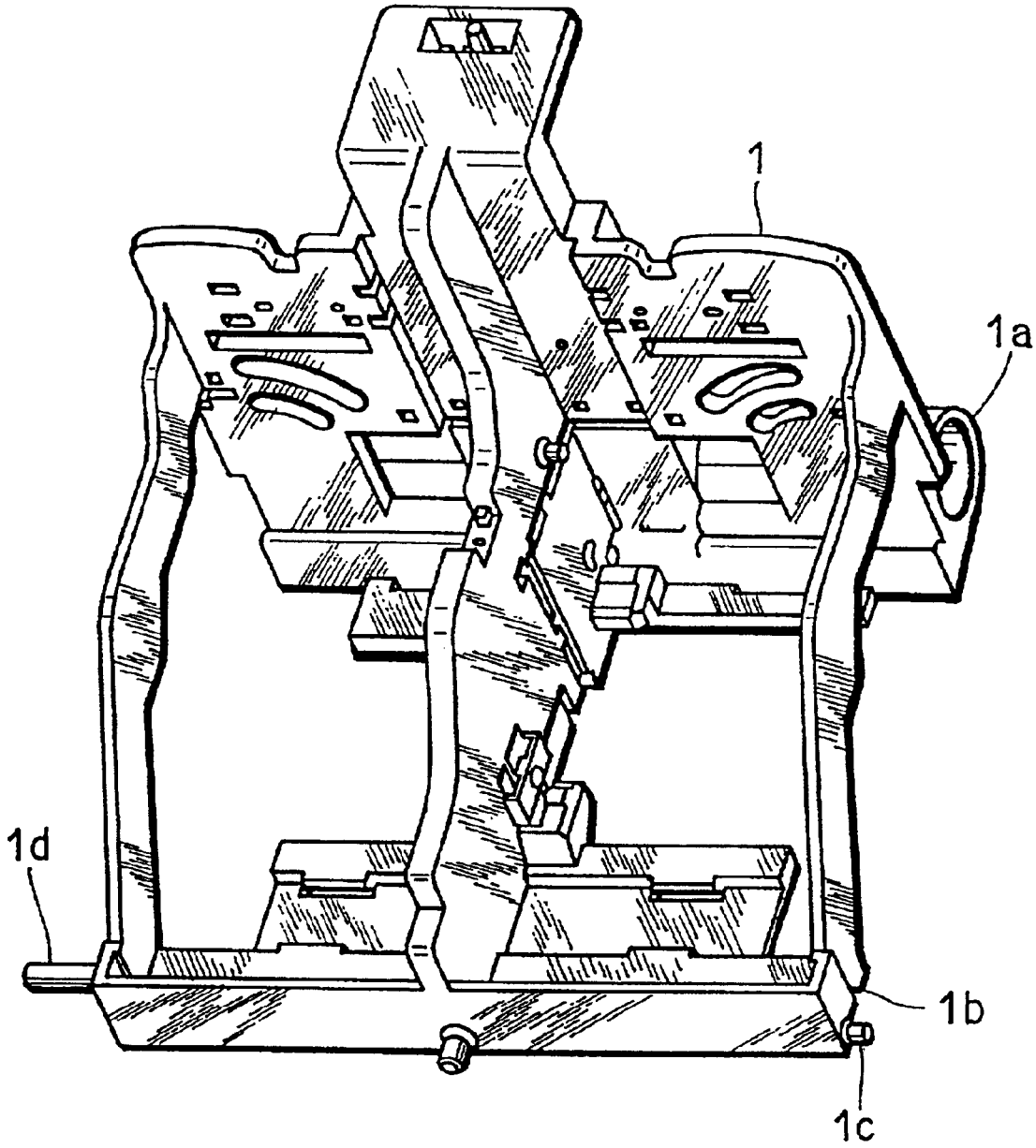
FIG. 5 is a view showing a structure of carriage 1 of the serial printer according to the embodiment of the present invention.

FIG. 5 is a view showing a structure of carriage 1 provided in the above described serial printer. Carriage 1 is hollow in shape and provided with ink cartridge 3 and ink tank 2 thereabove. Provided at the back lower end of carriage 1 is a bearing 1*a*. Slide shaft 4 on the back side is fitted into bearing 1*a*. A recess 1*b* is formed at a bottom front end portion of carriage 1. Holding shaft 6 on the front side abuts against recess 1*b* from below. Further, a protrusion 1*c* is provided at the front lower end portion on one side of carriage 1.

Carriage 1 moves to the right end of the moving scope in the main scanning direction when a power source of the serial printer is turned on and at the start of an image formation process. When the start of the image formation process is instructed, carriage 1 moves to the left end of the scope, and then reciprocates over the image formation scope in the main scanning directions corresponding to a width of the sheet of paper on which image is to be produced.

Figure 6:
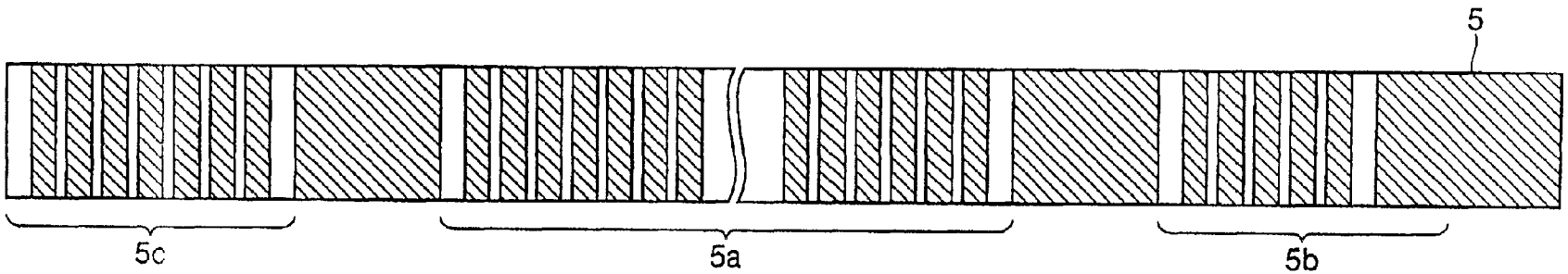
FIG. 6 is a front view showing a timing fence 5 of the serial printer according to the embodiment of the present invention.

FIG. 6 is a front view showing a timing fence provided in the above mentioned serial printer. Timing fence 5 is provided in serial printer body 51 such that it faces the back surface of carriage 1 over the entire moving scope in the main scanning direction of carriage 1. A reading surface of timing fence 5 which faces reading sensor 8 of carriage 1 has a printing region 5*a*, a height detecting region 5*b*, and a region for detecting a width of a sheet of paper 5*c* (hereinafter referred to as paper width detecting region 5*c*), which are respectively formed at an intermediate portion, near the right end portion, and near the left end portion. Each of printing region 5*a*, height detecting region 5*b* and paper width detecting region 5*c* has alternate white and black portions at regular intervals in the main scanning direction.

Like the timing fence provided in the conventional serial printer, printing region 5*a* is used for controlling constant-speed movement of carriage 1 during image formation. In other words, a length of printing region 5*a* in the main scanning direction corresponds to a length of a scope corresponding to a width of the maximum sized printing sheet of paper and lengths of accelerating regions which are provided at both ends of the scope and required for stationary carriage 1 to attain to a prescribed speed for image formation. Reading sensor 8 provided in carriage 1 reads an image in printing region 5*a* of timing fence 5 as carriage 1 moves for image formation. The moving speed of carriage 1 is controlled such that a period of change in images of white and black portions in the image read by reading sensor 8 matches a prescribed period.

Height detecting region 5*b* and paper width detecting region 5*c* are used for detecting a height of ink cartridge 3 and a length of the sheet of paper in the main scanning direction by a structure and a process which will later be described.

Figure 7:
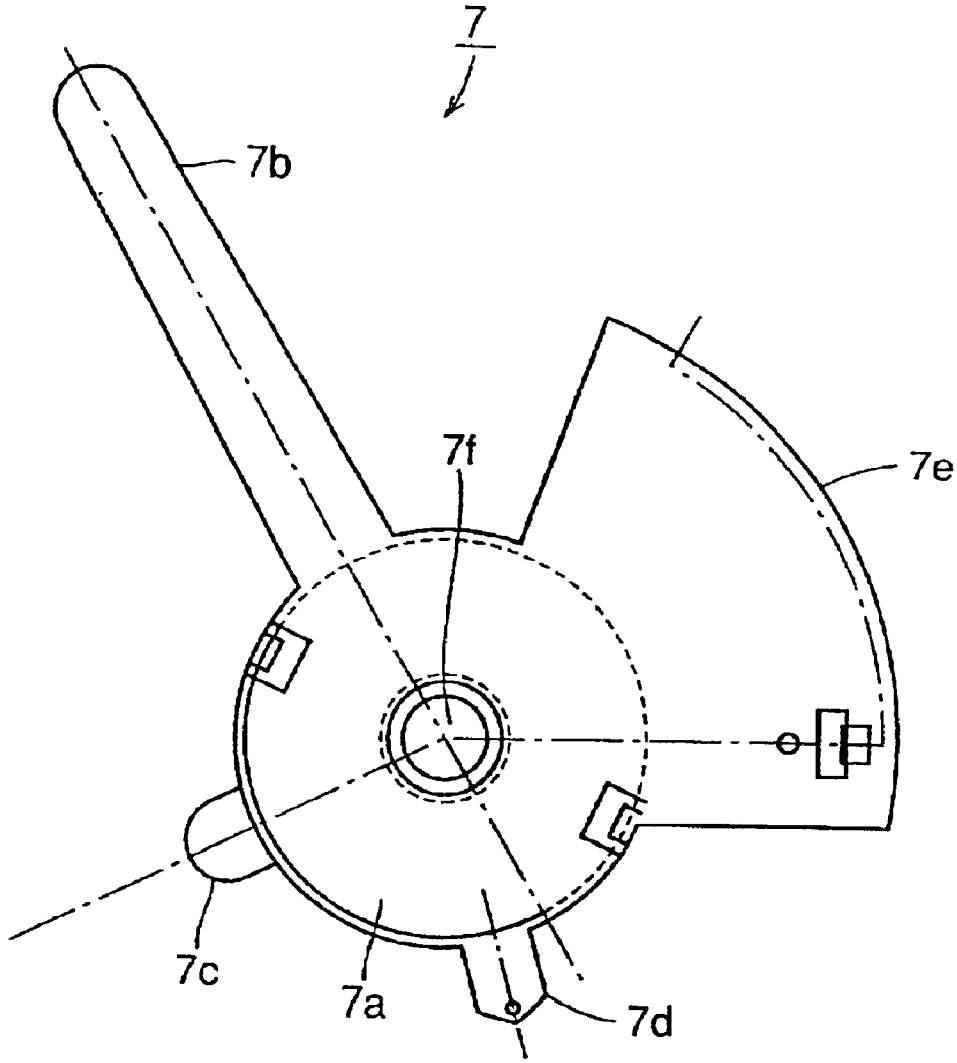
FIG. 7 is a side view showing an operating lever 7 provided in the serial printer according to the embodiment of the present invention.

FIG. 7 is a side view showing a structure of an operating lever provided in the above described serial printer. An operating lever 7 is provided on one side of serial printer body 51. Operating lever 7 has an operating portion 7*b*, stopper 7*c*, engaging piece 7*d*, and gear portion 7*e*, which are all protruding from base 7*a* in a disc-like shape. Operating lever 7 is pivotally supported about a hole 7*f* at the center of base 7*a* inside serial printer 51 between a position shown in FIG. 8A and a position shown in FIG. 8B which is apart from the position shown in FIG. 8A by a prescribed angle in a direction of an arrow A.

Operating portion 7*b* is exposed from the upper surface of serial printer body 51. Stopper 7*c* abuts against protrusion 1*c* of carriage 1 by rotation of operating lever 7. Engaging piece 7*d* engages with an elastic member 9. Elastic member 9 selectively stops operating lever 7 at one of the positions shown in FIGS. 8A and 8B. When operating lever 7 is at the position shown in FIG. 8A, stopper 7*c* does not abut against protrusion 1*c* of carriage 1. When operating lever 7 is at the position shown in FIG. 8B, stopper 7*c* abuts against protrusion 1*c* of carriage 1. Therefore, carriage 1 cannot vertically move above the position allowing protrusion 1*c* to abut against stopper 7*c*. Gear portion 7*e* mates with an adjust gear 4*a* fixed to one end of a rotation shaft of slide shaft 4.

Figure 9:
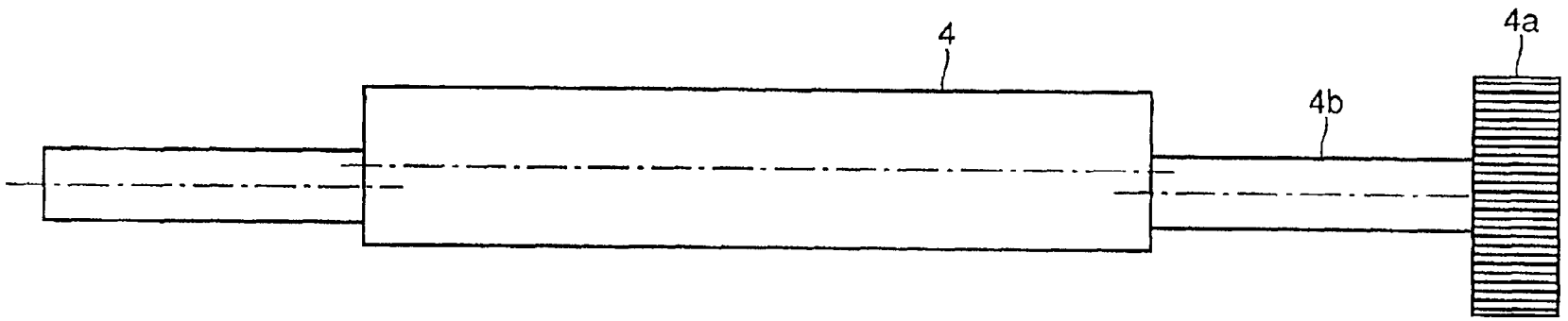
FIG. 9 is a front view showing a slide shaft 4 provided in the serial printer according to the embodiment of the present invention.

FIG. 9 is a front view showing a structure of slide shaft 4 provided in the above described serial printer. Slide shaft 4 is cylindrical in shape, and fitted into bearing 1*a* on the back side of carriage 1 over the entire moving scope in the main direction of carriage 1 inside serial printer body 51. Slide shaft 4 is eccentrically fixed to rotation shaft 4*b* having one end fixed to adjust gear 4*a*. As described above, adjust gear 4*a* mates with gear portion 7*e* formed at operating lever 7. Accordingly, slide shaft 4 rotates eccentrically with respect to rotation shaft 4*b* by rotation of operating lever 7.

Figure 10E:
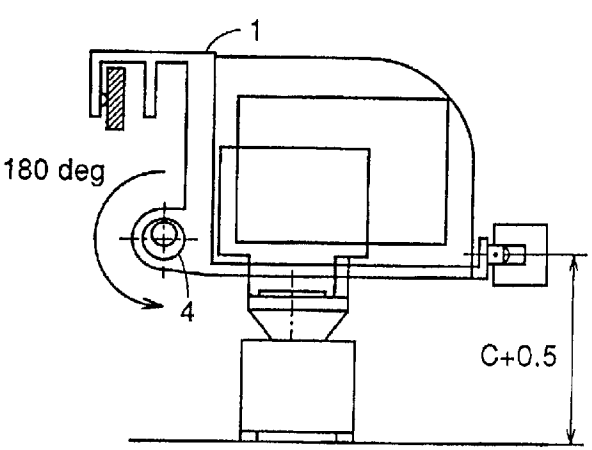
FIGS. 10A to 10F are diagrams shown in conjunction with upward and downward movements of carriage 1 by rotation of operating lever 7.
Figure 10C:
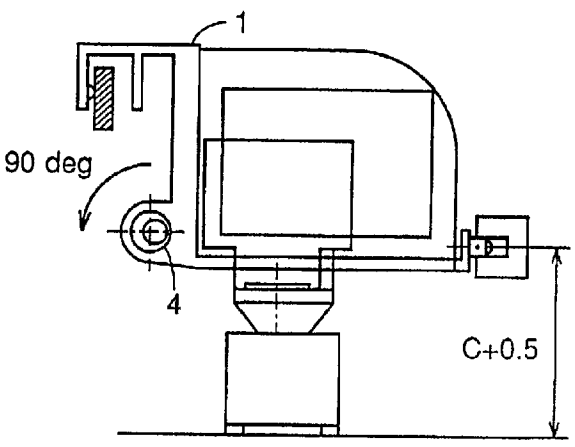
Figure 10A:
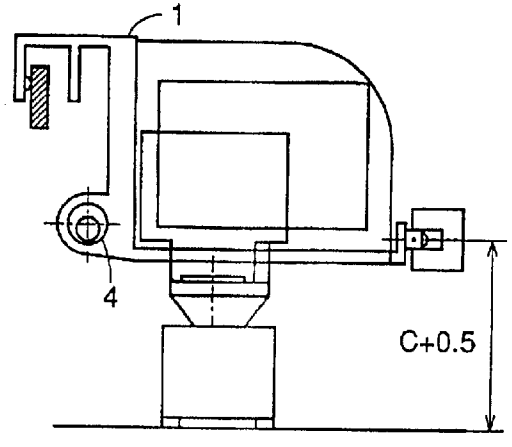

FIGS. 10A to 10F are diagrams shown in conjunction with upward and downward movements of carriage 1 by rotation of operating lever 7. It is noted that FIGS. 10A, 10C, and 10E are side views when carriage 1 is viewed from the left side of the serial printer.

Figure 8A:
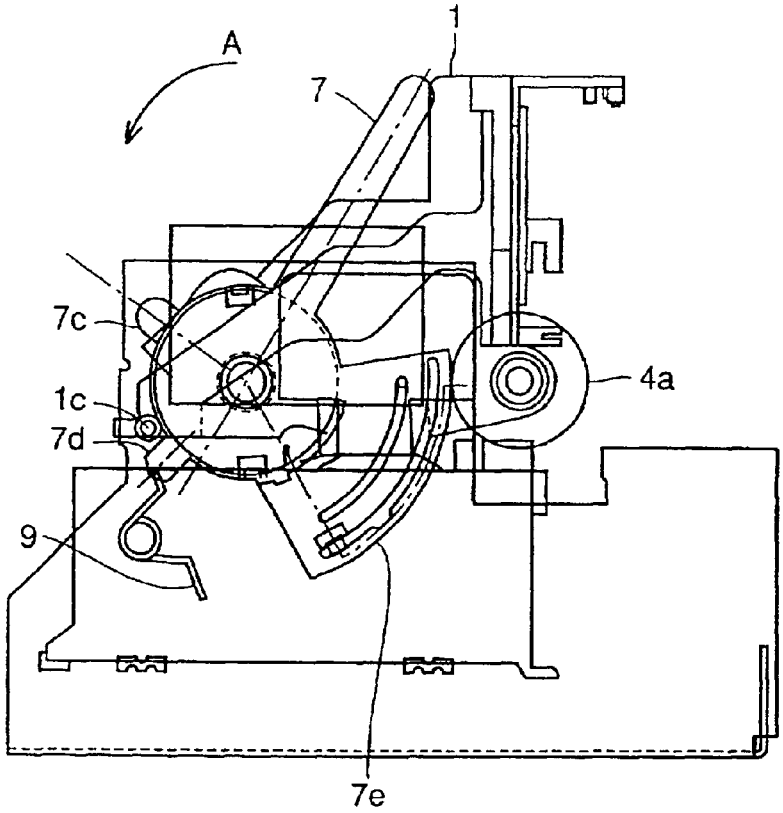
FIGS. 8A and 8B are views shown in conjunction with movement of the ink cartridge mounted on the carriage by operating lever 7.
Figure 8B:
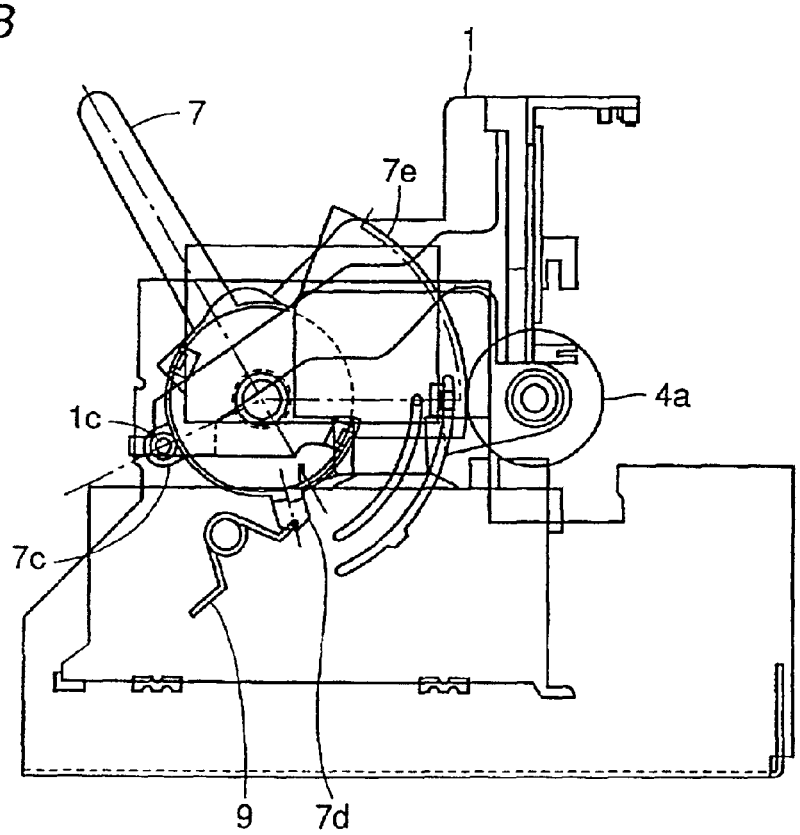
Figure 10F:
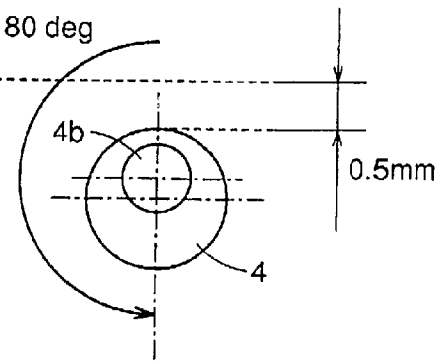
Figure 10D:
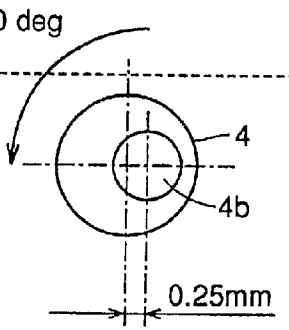
Figure 10B:
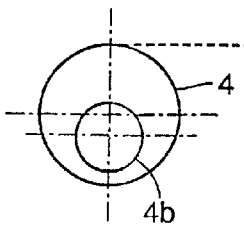

FIGS. 10A and 10B show positions of carriage 1 and states of slide shaft 4 when operating lever 7 is at the position shown in FIG. 8B. A center axis of slide shaft 4 is positioned above that of rotation shaft 4*b*, and the back side of carriage 1 is lifted from a normal position by about 0.5 mm.

FIGS. 10C and 10D show positions of carriage and states of slide shaft 4 when operating lever 7 is between the positions shown in FIGS. 8A and 8B. Rotation of rotation shaft 4*b* by 90° brings the center axis of slide shaft 4 at the same height as the center axis of rotation shaft 4*b*, so that the back surface of carriage 1 is positioned more or less below the position shown in FIG. 10A.

FIGS. 10E and 10F show positions of carriage 1 and states of slide shaft 4 when the operating lever 7 is at the position shown in FIG. 8A. The center axis of slide shaft 4 is positioned below the central axis of rotation shaft 4*b* and, the back surface of carriage 1 is at a normal position, i.e., at the position 0.5 mm below the position of carriage 1 shown in FIG. 10A.

Therefore, by selectively rotating operating lever 7 to positions shown in FIGS. 8A and 8B, the head of ink cartridge 3 mounted on carriage 1 can be reciprocated in the main scanning direction at the lower position corresponding to a plain sheet of paper or at the upper position corresponding to a thick sheet of paper. In addition, when the head of ink cartridge 3 mounted on carriage 1 is at the lower position corresponding to the plain sheet of paper, stopper 7*c* of operating level 7 does not abut against protrusion 1*c*. On the other hand, when the head of ink cartridge 3 mounted on carriage 1 is at the upper position corresponding to the thick sheet of paper, stopper 7*c* of ink cartridge 3 abuts against protrusion 1*c* of carriage 1.

Figure 11:
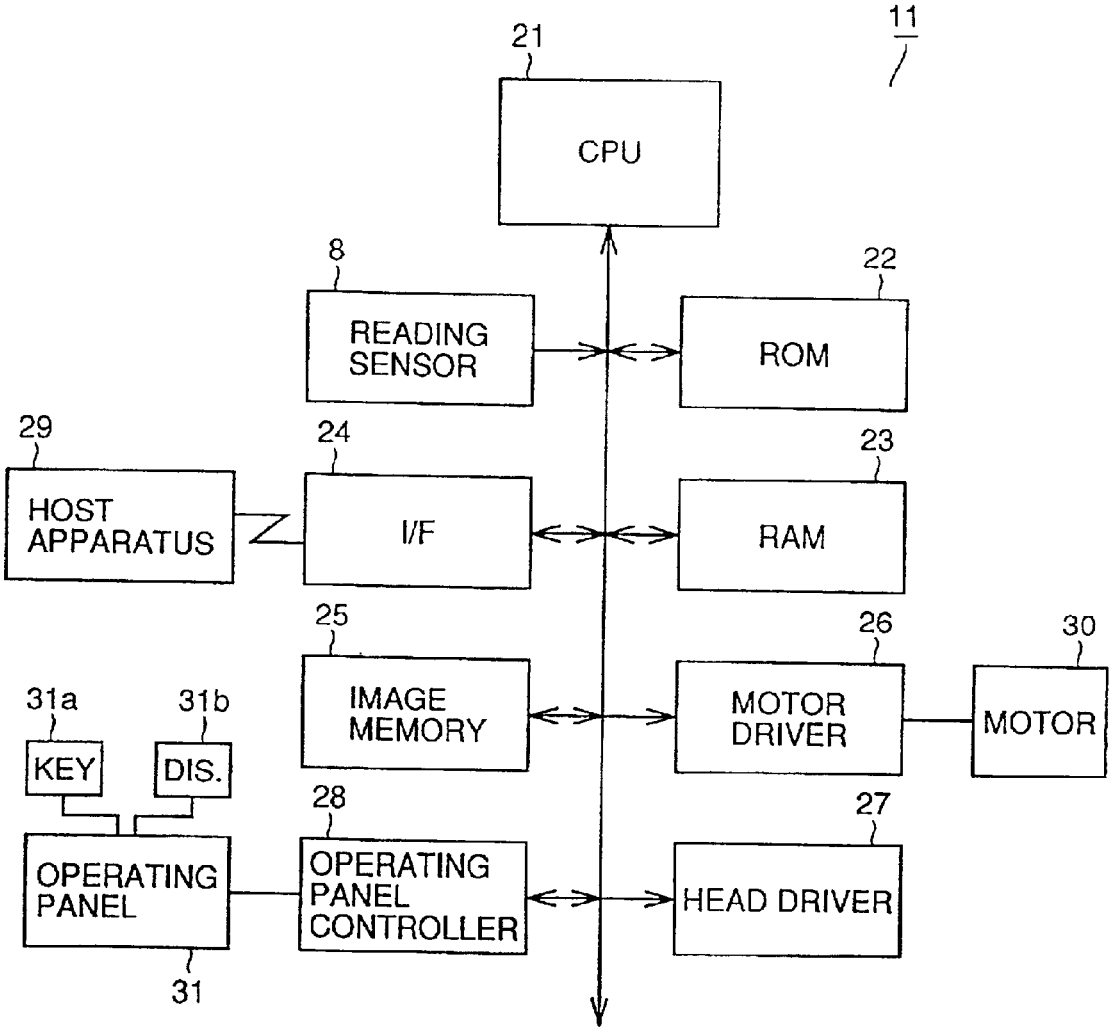
FIG. 11 is a block diagram showing a structure of a controlling portion 9 of the serial printer according to the embodiment of the present invention.

FIG. 11 is a block diagram showing a structure of controlling portion 11 of the above mentioned serial printer. Controlling portion 11 of the serial printer includes a CPU (Central Processing Unit) 21 provided with a ROM (Read Only Memory) 22 and a RAM (Random Access Memory) 23, which CPU 21 is connected to an input/output apparatus such as a reading sensor 8, interface 24, image memory 25, motor driver 26, head driver 27, and operating panel controller 28. CPU 21 controls the input/output apparatus in accordance with a program that has preliminarily been written to ROM 22. At the time, data which is input or output to or from CPU 21 is stored in a prescribed memory area of RAM 23.

Reading sensor 8 inputs read data of timing fence 5 to CPU 21. Interface 24 receives input data from a host apparatus 29 such as a personal computer. Image memory 25 stores the image data input through interface 24. Motor drive 26 drives a motor 30 in accordance with driving data output from CPU 21. Rotation of motor 30 is transmitted to carriage 1 through a transmitting mechanism (not shown) as a moving force in the main scanning direction. Head driver 27 drives the head of ink cartridge 3 in accordance with the driving data output from CPU 21. Operating panel controller 28 inputs operating data of a key switch 31 a provided in operating panel 31 to CPU 21, and displays display data output from CPU 21 onto a display 31*b*.

Figure 12:
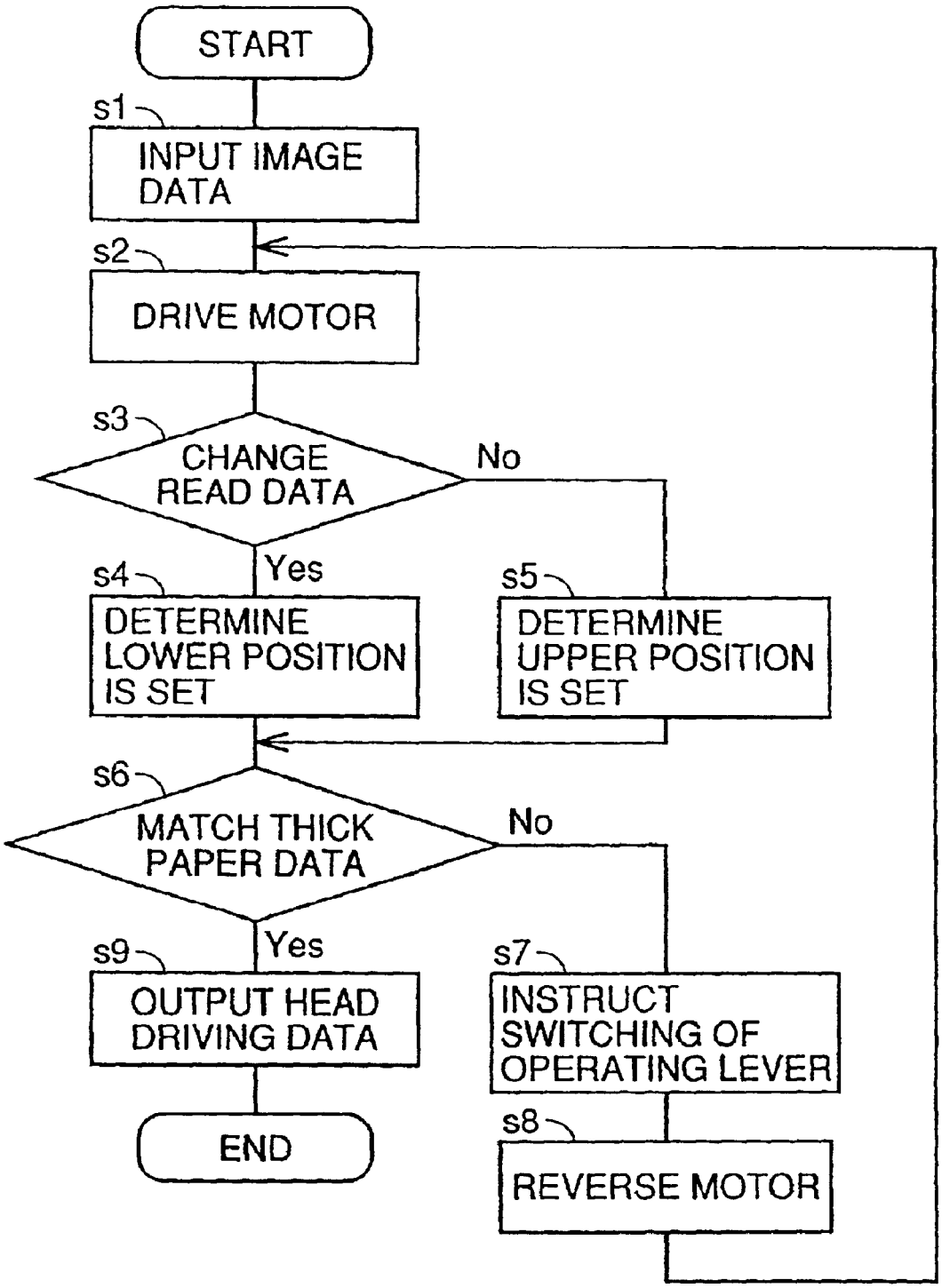
FIG. 12 is a flow chart showing a process of detecting a height of the ink cartridge according to the embodiment of the present invention.

FIG. 12 is a flow chart showing a process of detecting a height of the ink cartridge in the controlling portion of the above mentioned serial printer. CPU 21 forming the controlling portion of the serial printer according to the present invention detects an amount of movement of carriage 1 in the right end direction (the direction toward the right end of the apparatus) in accordance with read data of height detecting region 5*b* of timing fence 5, and determines whether protrusion 1*c* of carriage 1 abuts against stopper 7*c* formed at operating lever 7. Based on the determination result, it further determines to which one of the lower and upper positions, respectively corresponding to the plain sheet of paper and the thick sheet of paper, the head of ink cartridge 3 mounted on carriage 1 is set. CPU 21 compares the determination result with the data of the thickness of paper input from host apparatus 29, and determines if the position of the head of ink cartridge 3 is properly set by operating lever 7.

More specifically, when image data including thickness data of paper is input from host apparatus 29 via I/F 24 (s1), motor 30 is driven to move carriage 1 to a prescribed position in the right end direction (s2). At the time, CPU 21 determines if protrusion 1*c* of carriage 1 abuts against stopper 7*c* of operating lever 7, i.e., if the head of ink cartridge 3 is set to the lower position corresponding to the plain paper or the upper position corresponding to the thick paper (s3 to s5). CPU 21 compares the determination result with the thickness data of paper input from host apparatus 29 (s6) and, if both do not match (s6, No), displays a message instructing switching of the operating lever on display 31*b* of operating panel 31 (s7), reverses motor 30 by a prescribed amount (s8) and returns to step s2. If the determination result matches the thickness data of paper in step s6 (s6, Yes), CPU 21 outputs driving data of the head corresponding to the image data input from host apparatus 29 to head driver 27 and performs an image formation process (s9).

The set position of the head of ink cartridge 3 mounted on carriage 1 is detected using timing fence 5 and reading sensor 8 provided in the serial printer for detecting movement of carriage 1 in accordance with the above described process. Then, an image formation process is performed only when the detection result matches the thickness data of paper from host apparatus 29. The thickness data of paper input from host apparatus 29 to CPU 21 of the serial printer has been input to host apparatus 29 by an operator who sets sheets of paper to the serial printer, and the thickness data of paper input from host apparatus 29 generally corresponds to the thickness of the sheets of paper set on the feeding tray of the serial printer. Therefore, the above described process surely positions the head of ink cartridge 3 at the position corresponding to the thickness of the sheets of paper fed from the feeding tray which is to be printed.

In the serial printer, generally, carriage 1 is moved to the light end when the power source is turned on or before the image formation process is started. At the same time, operating lever 7 is provided on the right side of the serial printer body in consideration of its operating property. Thus, in the above embodiment, height detecting region 5*b* is arranged on the right end side of timing fence 5, and the position of the head of ink cartridge 3 is detected on the right end side of the apparatus where carriage 1 is positioned when the power source is turned on or before the image formation process is started. Thus, increase in size of the detection member and unnecessary movement of carriage 1 are prevented. In other words, when the power source is turned on or before the image formation process is started, moving carriage 1 to the right end also allows detection of the position of the head of ink cartridge 3.

Further, when sheets of paper are set after carriage 1 is moved to the right end, even if the head of ink cartridge 3 is set at the lower position corresponding to the plain paper, improper setting of the head can be detected before moving carriage 1 to the left end. Thus, the head is not brought into contact with the set sheets of paper as in the case of detecting the head position by moving carriage 1 toward the left end after setting the thick paper. As a result, head wearing or damage may be prevented.

In addition, formation of a plurality of stoppers at a plurality of positions in the main scanning direction in accordance with an amount of rotation of operating lever 7 enables correct detection of the position of the head of ink cartridge 3 even when the height of the head of ink cartridge 3 changes among more than three levels.

Figure 13:
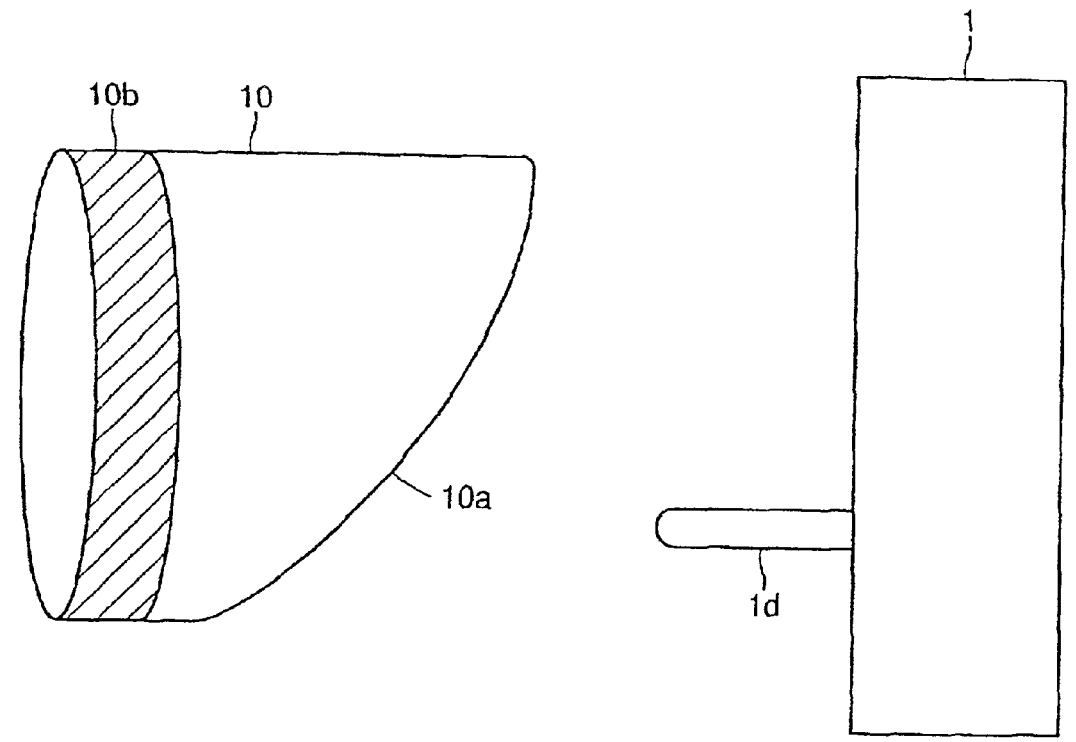
FIG. 13 is a diagram shown in conjunction with a mechanism for detecting a length of a sheet of recording paper in the main scanning direction.

FIG. 13 is a diagram showing a structure in conjunction with detection of a length of the sheet of paper in the main scanning direction in the serial printer according to the embodiment of the present invention. A switching lever 10 is rotatably arranged on the left end side in the main scanning direction of carriage 1. Switching lever 10 has a shape obtained by cutting a cylinder along a plane angled with respect to the axis. An abutting piece 1*d* protruding from a left side surface of carriage 1 abuts against an inclined surface 10*a*. The rotation shaft of switching lever 10 is arranged in parallel with the main scanning direction, which is the moving direction of carriage 1. Abutting piece 1*d* of carriage 1 abuts against a portion of inclined surface 10*a* which is displaced from the rotation shaft of switching lever 10.

In addition, gear portion 10*b* is formed at the left end portion of switching lever 10. The movement of guide plate 54 which is movably arranged on feeding tray 52 is transmitted to gear portion 10*b* through a transmitting mechanism (not shown). In other words, as shown in FIG. 2, guide plate 54 is movably provided on the upper surface of feeding tray 52 over a prescribed scope in the main scanning direction, and guide plate 54 abuts against a side surface parallel with the feeding direction of the sheet of paper placed on the upper surface of feeding tray 52 (the direction perpendicular to the main scanning direction). Therefore, guide plate 54 moves in the main scanning direction on the upper surface of feeding tray 52 along the length of the sheet of paper to be fed in the main scanning direction.

The movement of guide plate 54 is converted to rotational movement for example by a rack gear fixed to guide plate 54 and an intermediate gear which mates therewith. Then, the intermediate gear is directly, or indirectly through another gear, mated with gear portion 10*b* of switching lever 10, so that switching lever 10 rotates with movement of guide plate 54. Upon rotation of switching lever 10, the abutting position of inclined surface 10*a* of switching lever 10 and abutting piece 1*d* of carriage 1 in the direction of rotation shaft of switching lever 10 (the main scanning direction) changes. As a result, the moving scope of carriage 1 in the left end direction changes.

Figure 14A:
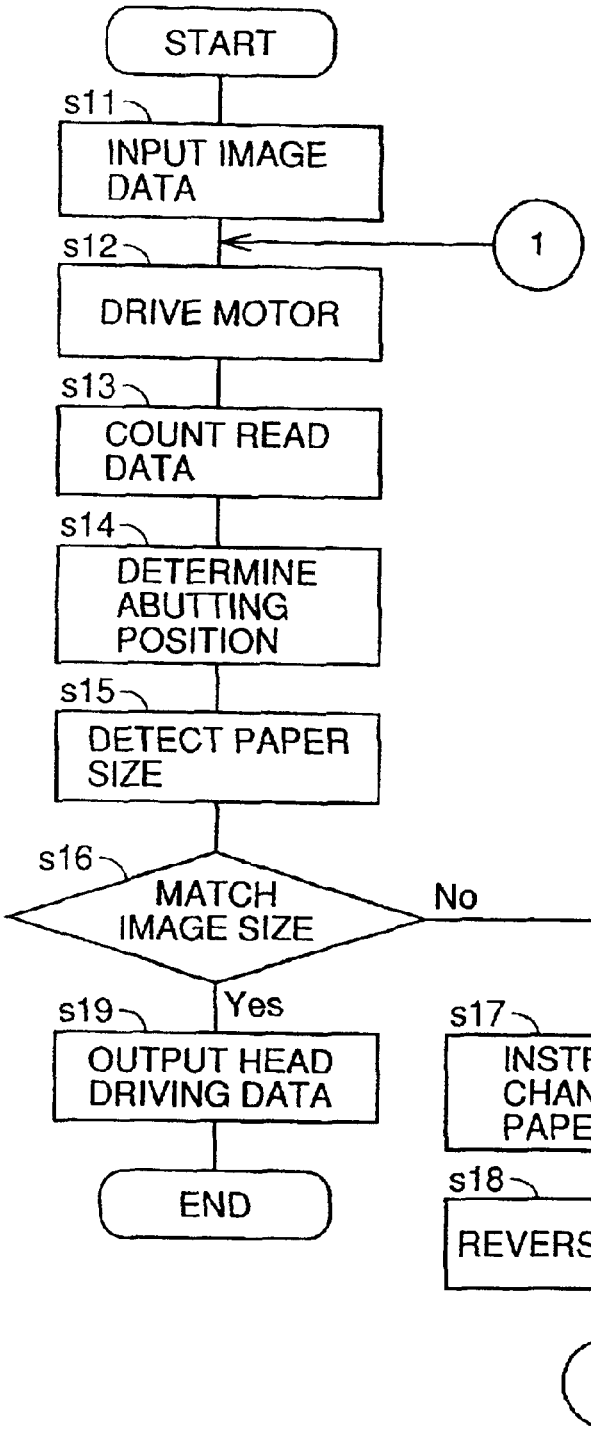
FIGS. 14A and 14B are flow charts showing a process of detecting a length of the sheet of paper in the main scanning direction.

FIG. 14A is a flow chart showing a process of detecting a length of the sheet of paper in the main scanning direction at the controlling portion of the above mentioned ink-jet printer. CPU 21 forming the controlling portion of the serial printer according to the present invention detects an amount of movement of carriage 1 in the left end direction based on read data of paper width detecting portion 5*c* of timing fence 5 from reading sensor 8. CPU 21 then determines the length of the sheet of paper in the main scanning direction which has been set on feeding tray 52 based on the detection result.

CPU 21 then compares the determination result with the size of the image data input from host apparatus 29, and determines if the set sheet of paper corresponds to the size of the image data. Further, CPU 21 determines a reciprocating scope in the main scanning direction of carriage 1 for image formation based of the determination result of the length in the main scanning direction of the sheet of paper which has been set on feeding tray 52.

More specifically, when the image data is input from host apparatus 29 (s11), CPU 21 drives motor 30 to move carriage 1 in the left end direction (s12). At the time, CPU 21 counts the white images in the read data from reading sensor 8 while driving motor 30 (s13) and, determines the abutting position of abutting piece 1*d* of carriage 1 and inclined surface 10*a* of switching lever 10 based on the count value (s14). Then, CPU 21 detects the size of the sheet of paper which has been set on feeding tray 52 based on the determination result (s15).

CPU 21 compares the detection result with the size of the image data in the main scanning direction input from host apparatus 29 (s16) and, when both do not match (s16, No), it displays a message instructing setting of the sheet of paper corresponding to the image data size on feeding tray 52 on display 31*b* of operating panel 31 (s17), reverses motor 30 by a prescribed amount (s18), and then returns to step s12. If the detection result matches the image data size in step s16 (s16, Yes), CPU 21 outputs driving data of the head in accordance with the image data input form host apparatus 29 to head driver 27 and performs the image formation process (s19).

The above described process enables the size of the sheet of paper which has been set on feeding tray 52 to be detected using timing fence 5 and reading sensor 8 provided in the serial printer for detecting movement of carriage 1. Then, the image formation process is performed only when the detection result matches the image data input from host apparatus 29. Thus, the sheet of paper which is smaller than the image data size is set on feeding tray 52. As a result, the problem associated with the taint damage is preliminary prevented, which is caused to the apparatus and the sheet of paper by ink emitted against the portion with no sheet of paper in accordance with the image data from the ink cartridge mounted on the carriage 1.

Figure 14B:
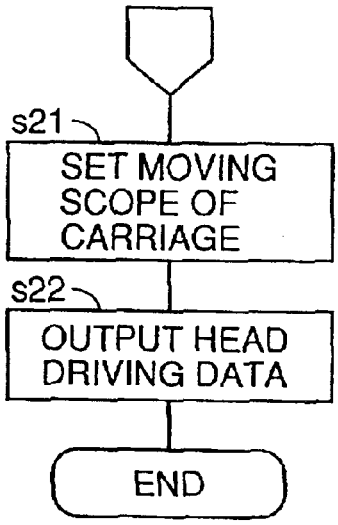

In addition, the image data input from host apparatus 29 to CPU 21 of the serial printer is generated in host apparatus 29 by an operator who sets the sheet of paper to the serial printer. Generally, the image data size input from host apparatus 29 matches the paper size set on the feeding tray 52. Then, when the detection result matches the image data size in s16 (s16, Yes), the reciprocating scope of carriage 1 in the main scanning directions at the time of image formation process is set in accordance with the paper size detected by s15, as shown in FIG. 14B (s21), so that the image formation process is performed (s22).

Further, as the abutting position of inclined surface 10*a* of switching lever 10 and abutting piece 1*d* of carriage 1 successively changes in accordance with the rotational amount of switching lever 10, even when there are printing sheets of paper with different sizes in the serial printer, the size of each sheet of paper can correctly be detected.

It is noted that, taking into account the fact that carriage 1 is moved to the right end portion before the image formation process is started and then it is further moved backed to the left end portion for image formation process, it is considered efficient to perform the process of detecting the height of the ink cartridge shown in FIG. 12 when carriage 1 is moved to the right end and then the process of detecting the length of the sheet of paper in the main scanning direction shown in FIG. 14A when carriage 1 is moved to the left end.

In addition, in the process of detecting the height of the ink cartridge shown in FIG. 12 and in the process of detecting the length of the sheet of paper in the main scanning direction shown in FIG. 14A, during movement of carriage 1 driving power smaller than that for image formation process is supplied, so that any impact caused when protrusion 1*c* or abutting piece 1*d* of carriage 1 abuts against stopper 7*c* or inclined surface 10*a* of switching lever 10 is reduced As a result, malfunction or damage of the apparatus is prevented.

Further, in timing fence 5, a color region which can be identified by reading sensor 8 is formed between printing region 5*a* and each of height detecting region 5*b* and paper width detecting region 5*c*. Thus, during the process of detecting the height of the ink cartridge and the process of detecting the length of the sheet of paper in the main scanning direction, it is correctly recognized that reading sensor 8 is brought into a position directly facing each of height detection region 5*b* and paper width detecting portion 5*c*, and operating state of operating lever 7 or guide plate 54 is not erroneously detected.

In addition, in steps s8 and s17 in FIGS. 12 and 14A, alert data may be output to the host apparatus which has output the image data.

The present invention can also be applied to detection of a set condition for image formation other than the height of the ink cartridge and the length of the sheet of paper in the main scanning direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A serial printer having an operating lever for setting a height of a head emitting ink onto a sheet of paper, and a timing fence for detecting movement in a main scanning direction of a carriage to which said head is mounted, comprising:

a stop position changing member changing a stop position of said carriage by an operation of said operating lever; and a controlling portion detecting the height of said head by using said timing fence to read an amount of movement of said carriage from when said carriage is started to move until said carriage is stopped at said stop position.

2. The serial printer according to claim 1, wherein said controlling portion detects the height of said head when a power supply is turned on or before an image formation process is started by emission of the ink.

3. The serial printer according to claim 1, wherein said controlling portion displays a message when the detected height of said head does not match a prescribed height of said head.

4. The serial printer according to claim 1, wherein said controlling portion outputs alert data to a host apparatus connected to a body of said serial printer when the detected height of said head does not match a prescribed height of said head.

5. A serial printer having a carriage for moving a head emitting ink onto a sheet of paper in a main scanning direction, a state of movement of the carriage in the main scanning direction being detected by a timing fence and a read sensor reading the timing fence for control of image formation, wherein said head is allowed to move upward and downward in accordance with a thickness of a sheet of paper, and a position for restricting the movement of the carriage is made to be changeable, said serial printer comprising means for detecting a height of said head by moving the carriage and then reading the timing fence by the read sensor.

6. The serial printer according to claim 5, wherein said head is moved upward and downward by rotating said carriage to which said head is mounted.

7. The serial printer according to claim 6, wherein the position for restricting the movement of the carriage is changed in accordance with the rotation of said carriage.

8. The serial printer according to claim 5, wherein said head is moved to an upper position when said sheet of paper is a thick sheet of paper, and said head is moved to a lower position when said sheet of paper is a plain sheet of paper thinner than the thick sheet of paper.

9. The serial printer according to claim 5, wherein the height of said head is detected by the movement of said carriage, and an instruction to switch between the upper and lower positions of said head is issued when the detected position of said head does not match input data of paper thickness.

10. The serial printer according to claim 5, wherein the height of said head is detected by the movement of said carriage, and an image formation process according to input image data is started when the detected position of said head matches input data of paper thickness.

11. A serial printer having a timing fence for detecting movement in a main scanning direction of a carriage to which a head is mounted, comprising:

said head having a height changeable in accordance with a thickness of a sheet of paper; and a detecting portion detecting a current height of said head by reading said timing fence for detecting an amount of movement of said head.

12. The serial printer according to claim 11, wherein movement of the head is restricted by changing the height of the head, and the height of the head is detected by reading an amount of movement of the timing fence in a position where the movement of said head is restricted.

13. The serial printer according to claim 12, wherein the head is moved in one direction before start of image formation, and the height of the head is detected based on the amount of movement of a carriage with respect to the timing fence in the position where the movement of said head is restricted.

14. A serial printer including a head having its height changeable in accordance with a thickness of a sheet of paper, comprising:

a timing fence for detecting an amount of movement of the head;

setting means for setting the height of the head in accordance with the thickness of the sheet of paper;

means for detecting the height of the head set in said setting means by reading the timing fence; and switching designating means for designating switching of the height of said head when the thickness of the sheet of paper corresponding to the detected height of said head does not match an input thickness of the sheet of paper.

15. A serial printer including a head having its height changeable in accordance with a thickness of a sheet of paper, comprising:

a timing fence for detecting an amount of movement of the head;

setting means for setting the height of the head in accordance with the thickness of the sheet of paper;

means for detecting the height of the head set in said setting means by reading the timing fence; and means for sending out a warning to a host apparatus when the thickness of the sheet of paper corresponding to the detected height of said head does not match an input thickness of the sheet of paper.

16. A print system comprising the serial printer according to claim 1 and a host apparatus outputting image data for printing to the serial printer.

17. A print system comprising the serial printer according to claim 5 and a host apparatus outputting image data for printing to the serial printer.

18. A print system comprising the serial printer according to claim 11 and a host apparatus outputting image data for printing to the serial printer.

19. A print system comprising the serial printer according to claim 14 and a host apparatus outputting image data for printing to the serial printer.

20. A print system comprising the serial printer according to claim 15 and a host apparatus outputting image data for printing to the serial printer.

21. The serial printer according to claim 1, comprising means for setting a driving force driving said carriage for detecting the height of said head weaker than a driving force driving said carriage at the time of image formation.

22. The serial printer according to claim 5, comprising means for setting a driving force driving said carriage for detecting the height of said head weaker than a driving force driving said carriage at the time of image formation.

23. The serial printer according to claim 11, comprising means for setting a driving force driving said carriage for detecting the height of said head weaker than a driving force driving said carriage at the time of image formation.

24. The serial printer according to claim 14, comprising means for setting a driving force driving said carriage for detecting the height of said head weaker than a driving force driving said carriage at the time of image formation.

25. The serial printer according to claim 15, comprising means for setting a driving force driving said carriage for detecting the height of said head weaker than a driving force driving said carriage at the time of image formation.

* * * * *